United States Patent [19]

Riley et al.

[11] Patent Number: 4,919,283

[45] Date of Patent: Apr. 24, 1990

[54] CONTAINER SHIP WORKER SAFETY SYSTEM

[75] Inventors: Robert E. Riley, San Rafael; John McNeill, Concord, both of Calif.

[73] Assignee: Marine Terminals Corporation, San Francisco, Calif.

[21] Appl. No.: 149,344

[22] Filed: Jan. 28, 1988

[51] Int. Cl.[5] ..... B66C 13/44

[52] U.S. Cl. ..... 212/160; 182/3; 212/206; 212/218; 212/219; 212/270

[58] Field of Search ..... 212/160, 190, 206, 205, 212/218, 219, 270; 414/137; 182/3, 8, 12, 14, 142; 294/81.2, 905

[56] References Cited

U.S. PATENT DOCUMENTS

| | | | |
|---|---|---|---|
| 3,559,817 | 2/1971 | Brown | 212/160 |
| 4,407,392 | 10/1983 | Lazzari | 182/3 |
| 4,546,852 | 10/1985 | Martin et al. | 182/12 |
| 4,566,599 | 1/1986 | Villa et al. | 212/160 |
| 4,676,339 | 6/1987 | Rybka et al. | 182/2 |
| 4,705,140 | 11/1987 | Dudley et al. | 182/3 |

*Primary Examiner*—Sherman D. Basinger
*Assistant Examiner*—Thomas J. Brahan
*Attorney, Agent, or Firm*—Townsend and Townsend

[57] ABSTRACT

A safety system helps prevent injury from falls from stacks of containers while loading and unloading container ships using an overhead trolley crane. The crane is of the type including a frame movable in fore and aft gantry directions, a trolley track supported by the frame and a trolley movable along the trolley track in on shore and off shore trolley directions. The trolley includes a container bridle which lifts and lowers the containers during loading and unloading operations. Workers walk on the containers to place and retrieve stacking cones at the corners of the containers. The workers ride in a cage on the bridle in getting onto and off of the containers. The operational status of the crane-normal speed, slow speed or stopped-is visually indicated to the worker by colored lights on the cab. Each worker is tethered to the bridle by a short (6'), two piece safety line in case the worker falls off the stack of containers. Each worker has a transmitter which can be used to stop the bridle in an emergency.

10 Claims, 3 Drawing Sheets

CONTAINER SHIP WORKER SAFETY SYSTEM

BACKGROUND OF THE INVENTION

Containerized shipping uses rectangular shipping containers of standard dimensions. The containers are commonly twenty feet or forty feet in length and are transported on container ships, stacked one on top of the other. The loading and unloading of the containers is commonly accomplished using overhead trolley cranes of the type having an overhead track which extends from the wharf or pier out over the container ship. The overhead track is supported by uprights, the uprights being supported on the pier by wheels. The wheels ride along tracks on the pier so the crane can move along the pier in what is called gantry directions. The overhead track and upright supports constitute the trolley support.

A trolley is supported by the overhead track and moves along the overhead track in off shore, that is away from the pier, and on shore directions called trolley directions. The trolley commonly includes a cab, within which the crane driver sits, and a container bridle. (The cab can, however, be mounted in a stationary manner to the trolley support.) The container bridle is raised and lowered by the operator and is used to pick up the containers at their corners during loading and unloading operations. The corners of the containers have special corner castings to which the bridle is secured. When desired to move the bridle over the ship forward or aft, the crane driver moves the trolley support and trolley therewith in the desired gantry direction by movement of the entire crane.

To insure that the containers are properly vertically situated, and to help prevent horizontal shifting between levels of containers, alignment cones are commonly used between stacked containers. After a level of containers has been placed on the container ship, a worker is lifted onto the top surface of the containers and places alignment cones in each of the corner castings. After doing so, the worker leaves the top level of containers and the next level of containers is placed on the container ship using the crane.

To keep the containers from shifting, various types of lashings are used to secure the ends of the containers to the ship. Therefore, space is left between the rows of the containers to permit the lashing of the containers to the ship. It has become apparent that when the lasher is working on the top of several levels of containers, the possibility of falling off the edge of the containers exists. To help prevent such accidents, safety systems have been devised.

One safety system uses nets positioned to basically prevent workers from falling from the containers. Erecting the safety nets is often quite difficult and itself exposes workers to the risk of falling. Another system uses a heavy, stationary structure, typically formed in the fashion of a heavy cage, on the top level of the containers. A variable length safety line extends from the heavy cage to a harness on the worker to permit the worker relative freedom of movement over the entire top level of containers. If the worker falls off the edge of the layer of containers, this will cause the safety line to begin to extend rapidly. This rapid extension is halted by a suitable clutch mechanism, similar to those used on a seat belt, so to keep the worker from falling all the way to the bottom of the ship. This system, however, has problems in that if the safety line is at a full extension, and if the worker falls off the edge, while the safety line may not get any longer, it still may be long enough to allow the worker to strike against the ship structure or containers. Also, the cage must be moved onto and off of the top level of containers between the loading or unloading of each level.

SUMMARY OF THE INVENTION

The present invention is directed to a safety system for use by workers on top of a level of containers on container ships, such as when the workers are used to place and retrieve stacking cones during loading and unloading containers onto and off of the container ships.

The safety system is used with an overhead trolley crane of the type having a trolley which moves above the container ship along the overhead track of the crane. The trolley is commonly the type having a cab, housing the crane driver, and a container bridle. The bridle is used to engage the containers at their corners during loading and unloading operations. The crane driver controls all movements of the trolley support, the trolley, the bridle and the crane itself.

During certain operations workers are present on the top layer of containers. Most commonly workers are required to place and retrieve stacking cones at the corners of the containers. The stacking cones help to guide containers which will make up an upper level of containers onto a lower level of containers.

To keep the worker from being injured if the worker happens to fall off the top level of containers, the worker is tethered to the bridle by a safety line. The safety line is preferably relatively short (e.g., 0.6 m to 3 m) and a fixed length. One end of the safety line is attached to some type of harness worn by the worker. The harness must be capable of halting the fall of the worker without the harness causing injury to the worker. The harness preferably is connected to one end of the safety line at an engagement point at the worker's back. The other end of the safety line is secured to a point on the bridle. The crane driver moves the bridle with the worker (typically behind the worker) so as to permit the worker substantially unimpeded freedom of movement while limiting the length of and the amount of slack in the safety line.

The safety line is preferably made of two segments, a worker segment attached to the worker and a bridle segment attached to the bridle. The segments are connected by an intermediate coupling along its length. This permits the worker to uncouple himself from the bridle without having to reach around behind his back or up to the bridle. When the intermediate coupling is released, the worker can simply drape the worker segment of safety line over his shoulder to keep it out of the way.

The system also includes a safety override system for preventing any movement of the bridle in emergency situations. Preferably, an override signal is provided through a transmitter and receiver. The receiver is part of an override circuit connected to the movement control circuit of the crane. The transmitter, controlled by an emergency stop button mounted to the transmitter, is worn by the worker at an accessible area, such as on the worker s chest to permit the worker to quickly halt all movement of the bridle in an emergency.

Another aspect of the invention relates to the use of visual indicators, such as signal lights, to indicate the mode of operation of the crane, that is normal (fast)

speed, slow speed or stopped. The signal lights are positioned to be easily visible to the worker so the worker always knows the operational status of the crane. In the preferred embodiment a green light indicates stopped a blue light indicates slow speed operation and no lights indicates normal speed operation.

In one embodiment of the invention, the procedure begins with the worker riding in a cage on the bridle until the bridle comes to rest on top of a container. The worker then gets off the bridle and connects the worker and bridle segments of the safety line using the intermediate coupling. The crane driver, preferably operating in the slow (blue light) mode, then raises the bridle an appropriate distance, typically so the bottom of the bridle is a short distance above the worker's head. The worker then performs the necessary tasks, preferably moving from the off shore side of the ship towards the on shore side of the ship with the bridle following the worker. After the job is accomplished, the bridle is moved back towards a central location, away from the shore side container, and is lowered onto a container. The worker, after disconnecting the worker segment of the safety line from the bridle segment of the safety line, gets back into the cage on the bridle. The crane driver then moves the bridle, with the worker on top, to prepare to start the next job.

A primary advantage of the invention is that it eliminates the need to put up safety nets to protect workers working on the top level of containers. The length of the safety line can be limited to a relatively short length which will help insure that a worker who falls from the edge of a level of containers can not fall far enough to sustain serious injury. Also, with the present invention, since the safety line is a fixed length, no reliance on the proper operation of an inertial clutch or other such mechanism, used with the prior art variable length safety lines, is necessary. Almost no modification needs be done to a conventional trolley crane to allow the use of the fixed length safety line.

The emergency override aspect of the present invention can be used with conventional overhead trolley cranes with minimal modifications, primarily adding appropriate circuitry to work with the movement control system of the crane to allow the worker to halt movement of the bridle. This relatively simple modification, coupled with the emergency override transmitter worn by the worker, allows the worker to immediately halt any movement of the bridle when such movement could endanger the worker.

Other features and advantages of the invention will appear from the following description in which the preferred embodiment has been set forth in detail in conjunction with the accompanying drawings.

DETAILED DESCRIPTION OF THE PREFERRED EMBODIMENT

Figure 1:
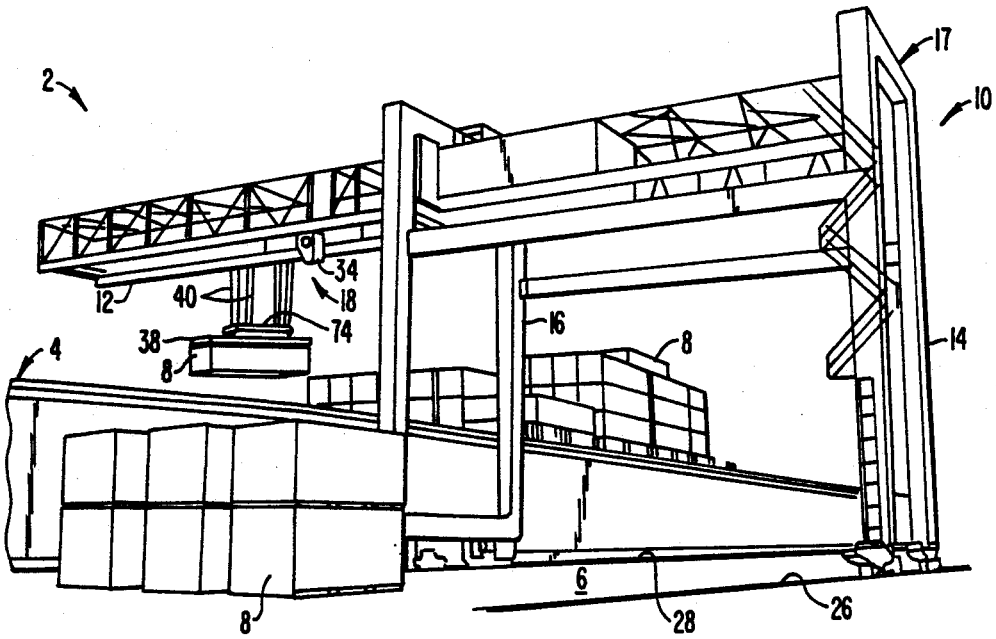
FIG. 1 is a perspective view showing a container ship and an overhead trolley crane in the process of loading the container ship with the containers.
Figure 2:
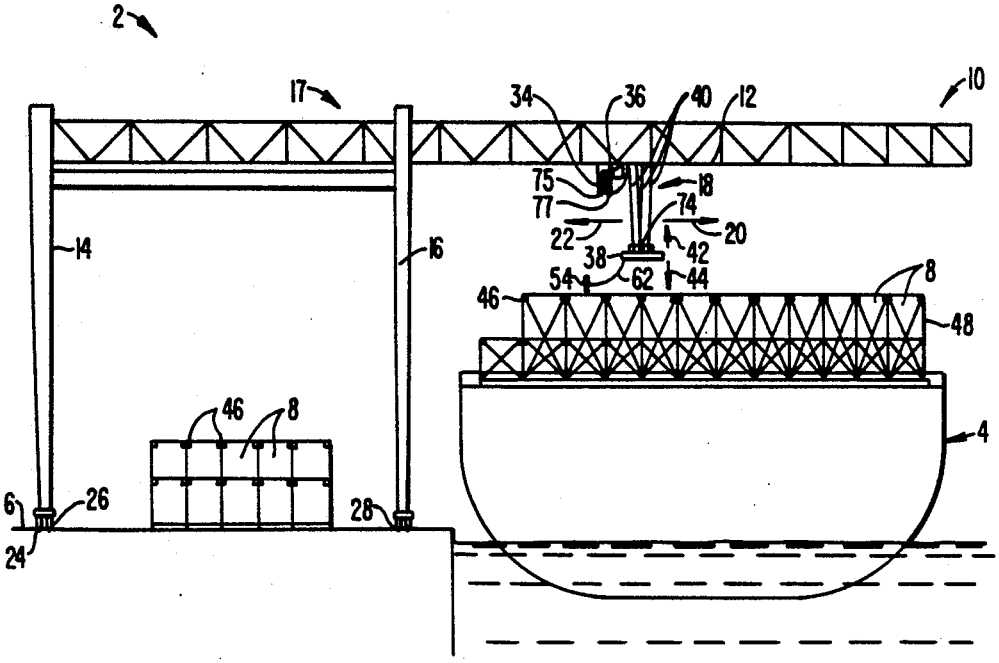
FIG. 2 is a simplified side view of the container ship and overhead trolley crane of FIG. 1 showing a worker connected to the bridle by a safety line.
Figure 4:
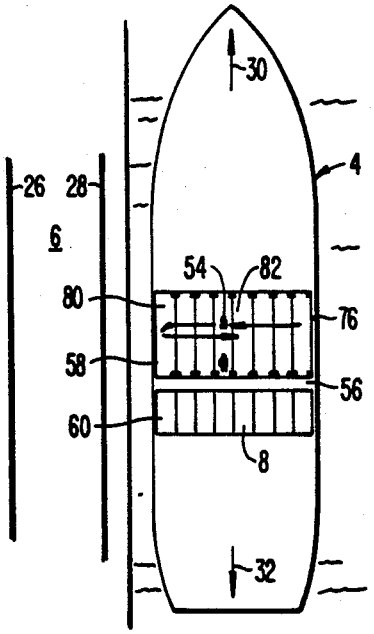
FIG. 4 is a simplified top view of the container ship and pier of FIG. 1 showing the direction of movement of the bridle while workers place stacking cones on the corner castings of the containers.

Referring now to FIGS. 1, 2 and 4, the container ship worker safety system 2 is shown used with a container ship 4 moored alongside a wharf or pier 6 and being loaded with containers 8 by an overhead trolley crane 10. Crane 10 includes a track 12 supported over ship 4 in a cantilevered fashion by supports 14, 16. Supports 14, 16 and track 12 constitute a crane support 17. Crane 10 also includes a trolley 18, movably supported beneath track 12, which moves in off shore and on shore trolley directions 20, 22. Supports 14, 16 ride on wheels 24 which engage tracks 26, 28 on pier 6 which permits crane 10 to move in forward and aft gantry directions 30, 32.

Figure 3:
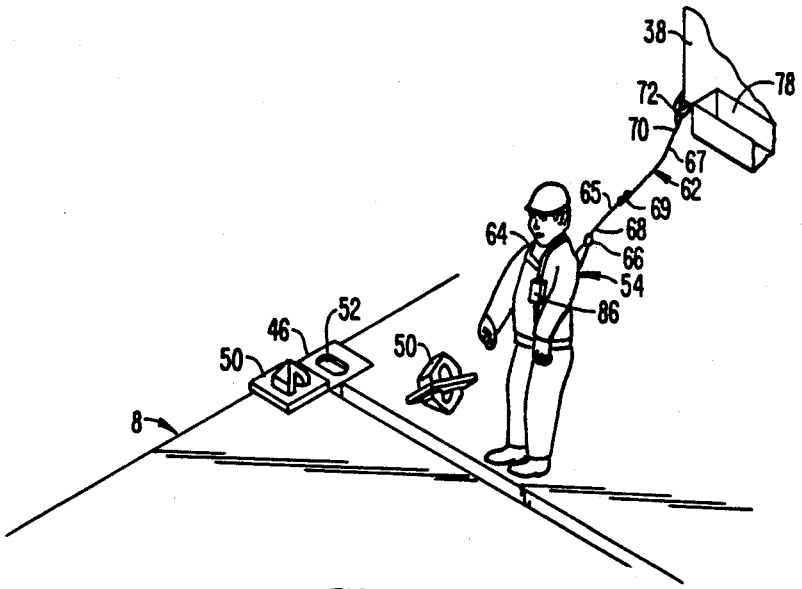
FIG. 3 shows the worker wearing a harness, being tethered to the bridle by a safety line, and having a transmitter fastened to the harness on the workers chest.

Trolley 18 includes a cab 34, containing a crane driver 36, and a bridle 38, suspended from crane track 12 by cables 40. Crane driver 36 controls all movement of crane 10, including movement of crane support 17 in gantry directions 30, 32, movement of trolley 18 in trolley directions 20, 22, and movement of bridle 38 in hoist and lower directions 42, 44. During loading of a container 8, bridle 38 engages the corner castings 46 (see FIG. 3) of a container 8 located on pier 6, lifts the container by moving bridle 38 in hoist direction 40, moves trolley 18 and the container therewith over ship 4, and lowers the container onto either the bottom of ship 4 or onto containers 8 already on ship 4. Prior to placing one container 8 onto another container 8, alignment cones 50 are placed within openings 52 in corner castings 46 by one or more workers 54.

To help prevent workers 54 from being injured in the event the worker falls from a layer 48 of containers 8, such as into a space 56 between two rows 58 and 60 of containers 8 or off of the side of an outside container 76 or 80, worker 54 is secured to bridle 38 by a safety line 62. Safety line 62 is long enough to permit necessary freedom of movement of worker 54 and yet short enough that if worker 54 falls off of layer 48 of containers 8, safety line 62 will quickly halt the worker's fall to help prevent death or serious injury. Presently, safety line 62 is expected to be in the range of two to ten feet (0.6 to 3 m) in length, typically about six feet (1.8 m). Worker 54 wears a harness 64 having an attachment point 66 in the middle of the worker's back. A harness end 68 of safety line 62 is fastened to harness 64 at attachment point 66 while a bridle end 70 of safety line 62 is fastened to bridle 38 at a connector 72. Safety line 62 preferably includes a worker segment 65 at harness end 68 and a bridle segment 67 at harness end 70 coupled by an intermediate coupler 69. Worker segment 65 is long enough to allow worker 54 to easily connect and disconnect coupler 69 thus eliminating the need for worker 54 trying to disconnect safety line 62 at attachment point 66. Of course worker segment 65 could be made part of harness 64 if desired.

Turning now also to FIG. 4, the preferred mode of operation of safety system 2 will be discussed. Crane driver 36 moves trolley 18 until bridle 38 is resting on pier 6. One or more workers 54, each wearing a harness 64 and having a worker segment 65 of a safety line 62 fastened at attachment point 66, climb onto bridle 38 and into a safety cage 74 on the top of bridle 38. A bridle segment 67 is connected to bridle 38 at connector 72 for each worker 54. Driver 36 then moves bridle 38 and places bridle 38 onto the top of the off shore most container 76. Worker 54 then departs cage 74 of bridle 38 in the on shore trolley direction 22 for sake of safety. Worker 54 then connects worker segment 65 to bridle segment 67 using intermediate coupler 69. Crane driver 36 raises bridle 38 (which can occur either before or after worker 54 connects segments 65 and 67) a distance sufficient to clear the worker's head.

Worker 54 removes alignment cones 50 from a basket 78 carried by bridle 38 and places cones 50 into engagement with holes 52 of corner castings 46. Preferably, two workers 54 are used to accomplish this, one walking along each end of row 58 of containers 8. Workers 54 are in front, that is in on shore trolley direction 22 as shown in FIG. 2, of bridle 38. Crane driver 36 moves bridle 38 slowly in on shore trolley direction 22 thus following worker 54.

Trolley 18 can be in three operational modes: stopped, normal speed and slow speed. While workers 54 are tethered to bridle 38, crane driver 36 limits trolley 18 to the slow speed mode. Crane 10 indicates the mode of operation by the use of blue and green signal lights 75 and 77 on the bottom of cab 34. See FIGS. 2 and 5. Illumination of blue light 75 means slow speed operation is in effect, illumination of green light 77 means the trolley is shut down (no movement possible) while no lights mean normal speed operation. The slow, blue light speed is slower than worker 54 can walk and is used when workers 54 are nearby for safety reasons. This feature permits workers 54 to immediately determine the operational status of crane 10 for increased safety. If desired, a horn or other temporary audible signal could be used to signal when driver 36 changes the operational status of crane 10, such as from slow speed to normal speed.

When worker 54 gets to on shore most container 80, driver 36 halts the movement of bridle 38. For safety reasons, driver 36 then reverses the direction of bridle 38 and moves bridle 38 in off shore trolley direction 20 to an intermediate container 82. At this point bridle 38 is lowered onto intermediate container 82. Worker 54 disconnects bridle segment 67 from worker segment 65 and climbs back onto bridle 38 and into safety cage 74. Crane driver 36 then moves bridle 38 to a discharge point, such as on pier 6, at which workers 54 can get off of bridle 38 allowing bridle 38 to be used to load the next level of containers 8.

Figure 5:
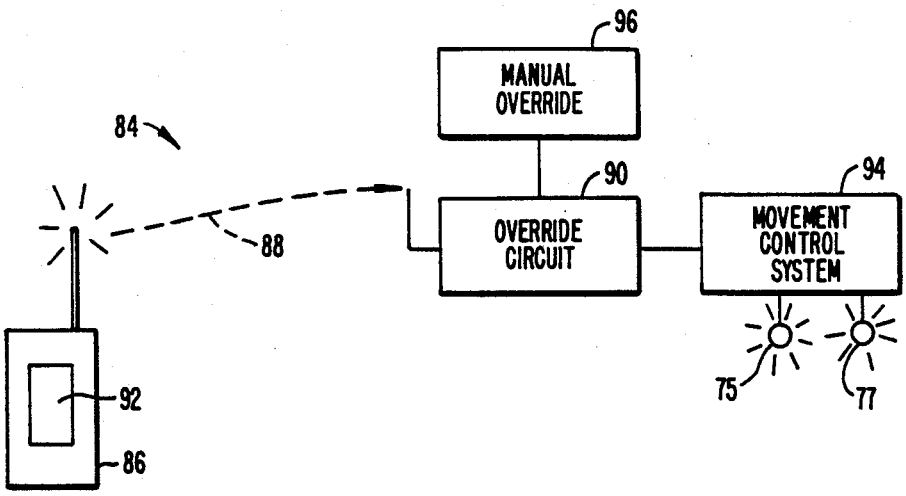
FIG. 5 is a simplified schematic view showing the emergency stop transmitter transmitting a signal to an override circuit coupled to the movement control system.

There may be times during which worker 54 need to override the operation of bridle 38 by crane driver 36 causing the bridle to stop. For example, if crane driver 36 becomes incapacitated, worker 54 would want to be able to halt all movement of bridle 38 before being dragged off an end container 8. To do so, an override system 84, shown schematically in FIG. 5, is used. System 84 includes an emergency stop transmitter 86 which provides an override signal 88 to an override circuit 90 whenever worker 54 presses emergency stop button 92. Transmitter may be one made by Linear Control Specialty Co. of South San Francisco. Calif. Override circuit 90 is connected to the movement control system 94 of crane 10. Override circuit 90 is constructed so to override movement control system 94 whenever an override signal 88 is received causing all movement of bridle 38 in any direction to stop. That is, provision of override signal 88 to override circuit 90 effectively shuts down crane 10. Override circuit 90 is preferably constructed to permit a manual override 96 to be used to return control of crane 10 to crane driver 36.

Modification and variation can be made to the disclosed embodiment without departing from the subject of the invention as defined in the following claims. For example, although override system 84 is preferably a telemetric system using radio wave type transmitter 86, emergency stop button 92 could be hard-wired to override circuit 90 as well. The invention has been described in terms of placing and, by analogy, removing alignment cones 50 for the proper positioning and securement of containers 8 stacked on top of one another. However safety system 2 could also be used while workers 54 are performing other tasks on the top of a layer of containers 8. Instead of different color of status signal lights 75, 77, the operational status of crane 10 could be indicated by displaying a different number or arrangement of lights: by using a light which blinks, stays steadily illuminated or is off; or by displaying different types of flags according to the operational status.

What is claimed is:

1. A safety system, for use by workers on top of levels of containers on container ships, such as when the workers are used to place and retrieve stacking cones while loading and unloading the container ships, using an overhead trolley crane of the type having a frame movable in forward and aft gantry directions, an operator's station housing a crane driver and supported by the frame, an overhead track supported by the frame, and a trolley which moves along the overhead track in on shore and off shore trolley directions, the trolley including a container bridle, the bridle movable in hoist and lower directions, the movement of the bridle being controlled by the crane driver through a movement control system, the safety system comprising:

a safety line;

the safety line including a coupling for selectively connecting the worker to the bridle through the safety line;

status signaling means, coupled to the movement control system, for visually signaling at least first, second and third operational statuses of the crane to the worker;

the first, second and third operational statuses being stopped, slow speed and normal speed operational statuses of the bridle;

override means, coupled to the movement control system, for preventing movement of the bridle when actuated; and switch means, carried by the worker, for actuating the override means;

whereby the worker can at least temporarily prevent all movement of the bridle through the switch means.

2. The safety system of claim 1 wherein the status signaling means includes different color lights.

3. The safety system of claim 1 wherein the safety line is a fixed length line.

4. The safety system of claim 1 wherein the safety line includes first and second segments.

5. The safety system of claim 1 wherein the switch means includes a transmitter and the override means includes a receiver adapted to be responsive to transmissions from the transmitter.

6. The safety system of claim 1 wherein the safety line is between about 2 feet and 10 feet long.

7. The safety system of claim 1 further comprising a harness worn by the worker having a connection point adjacent the worker's back, and wherein the safety line is fastened to the connection point.

8. A safety system, for use by workers on top of levels of containers on container ships, such as when the workers are used to place and retrieve stacking cones while loading and unloading the container ships, using an overhead trolley crane of the type having a frame movable in forward and aft gantry directions, an operator's station housing a crane driver and supported by the frame, an overhead track supported by the frame, and a trolley which moves along the overhead track in on shore and off shore trolley directions, the trolley including a container bridle, the bridle movable in hoist and lower directions, the movement of the bridle being controlled by the crane driver through a movement control system, the safety system comprising:

a safety line;

the safety line including a coupling for selectively connecting the worker to the bridle through the safety line:

status signaling means, coupled to the movement control system, for visually signaling at least first, second and third operational statuses of the crane to the worker;

the first, second and third operational statuses being stopped, slow speed and normal speed operational statuses of the bridle;

override means, coupled to the movement control system, for preventing movement of the bridle when actuated; and switch means, actuated by the worker, for actuating the override means;

whereby all movement of the bridle can be at least temporarily prevented through the actuation of the switch means.

9. The safety system of claim 8 wherein the switch means is carried by the worker.

10. The safety system of claim 8 wherein the switch means is actuated by a conscious action of the worker.

* * * * *